US006267641B1

(12) United States Patent
Vanell et al.

(10) Patent No.: US 6,267,641 B1
(45) Date of Patent: Jul. 31, 2001

(54) METHOD OF MANUFACTURING A SEMICONDUCTOR COMPONENT AND CHEMICAL-MECHANICAL POLISHING SYSTEM THEREFOR

(75) Inventors: James F. Vanell, Tempe; Chad B. Bray, Chandler, both of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/574,969

(22) Filed: May 19, 2000

(51) Int. Cl.[7] ..... B24B 49/00; B24B 51/00

(52) U.S. Cl. ..... 451/6; 451/99; 451/87

(58) Field of Search ..... 438/692; 156/345, 156/636.1, 640.1; 216/88, 89, 92; 134/36; 451/41, 6, 5, 87, 88, 99, 100, 101

(56) References Cited

U.S. PATENT DOCUMENTS

| | | | | |
|---|---|---|---|---|
| 5,597,595 | | 1/1997 | DeWille et al. | 426/74 |
| 5,750,440 | | 5/1998 | Vanell et al. | 438/692 |
| 5,755,614 | | 5/1998 | Adams et al. | 451/60 |
| 5,846,398 | * | 12/1998 | Carpio | 205/775 |
| 5,905,571 | | 5/1999 | Butler et al. | 356/328 |
| 5,911,619 | | 6/1999 | Uzoh et al. | 451/5 |
| 5,914,275 | | 6/1999 | Kodera et al. | 438/693 |
| 5,922,606 | | 7/1999 | Jenkins et al. | 436/55 |
| 5,939,831 | | 8/1999 | Fong et al. | 315/111.21 |
| 6,106,728 | * | 8/2000 | Iida et al. | 210/743 |
| 6,126,531 | * | 10/2000 | Iida et al. | 451/447 |
| 6,183,352 | * | 2/2001 | Kurisawa | 451/87 |

OTHER PUBLICATIONS

Omron, "Fuzzy Guide Book", 1992, whole book.
Rosemount Analytical, "Process Refractometer" Instruction Manual–P/N 510REFRACDS, May 1998, Chapters 1.0–1.3.
Rosemount Analytical, "Process Refractometer" Product Data Sheet–PDS 71–REFRACDS, Feb. 1998, pp. 1–3.

* cited by examiner

*Primary Examiner*—Derris H. Banks
(74) *Attorney, Agent, or Firm*—Robert F. Hightower

(57) ABSTRACT

A method of manufacturing a semiconductor component includes forming a first layer over a semiconductor substrate, providing a mixture comprised of a first component and a second component, optically detecting a concentration of the first component in the mixture, and applying the mixture to the first layer. A chemical-mechanical polishing (CMP) system (100) for use in the method includes a vessel (110) having a first input port (111), a CMP slurry output port (113), and a CMP slurry sensing port (114). The CMP system also includes a refractometer (150) adjacent to the CMP slurry sensing port.

6 Claims, 4 Drawing Sheets

| FLOW \ CONCENTRATION | NL | NM | NS | ZR | PS | PM | PL |
|---|---|---|---|---|---|---|---|
| PL | PL | PL | PM | PM | PS | PS | ZR |
| PM | PL | PM | PM | PS | PS | ZR | NS |
| PS | PM | PM | PS | PS | ZR | NS | NM |
| ZR | PM | PS | PS | ZR | NS | NM | NL |
| NS | PS | PS | ZR | NS | NM | NL | NL |
| NM | PS | ZR | NS | NM | NL | NL | NL |
| NL | ZR | NS | NM | NL | NL | NL | NL |

METHOD OF MANUFACTURING A SEMICONDUCTOR COMPONENT AND CHEMICAL-MECHANICAL POLISHING SYSTEM THEREFOR

FIELD OF THE INVENTION

This invention relates, in general, to manufacturing semiconductor components, and more particularly, to detecting concentrations of components in mixtures used in the manufacturing of semiconductor components.

BACKGROUND OF THE INVENTION

Chemical-Mechanical Polishing (CMP) slurries can be used to planarize metal layers. Such CMP slurries can include a buffered solution, an oxidizer, and an abrasive. The oxidizer chemically passivates or oxidizes the metal, and the abrasive physically polishes or removes the oxidized metal, which is softer than the unoxidized metal. CMP slurries for polishing tungsten metals require precise quantities of the oxidizer, which has an extremely short useful lifetime. Therefore, the new quantities of the oxidizer must be added to the CMP slurry to maintain the necessary chemical activity.

Prior techniques for determining when additional amounts of oxidizer are required include manual techniques such as titration. Typically, these manual techniques require at least a quarter of an hour to complete before the appropriate amount of oxidizer to be added to the CMP slurry is determined. This long delay between the sampling of the CMP slurry and the addition of the oxidizer to the CMP slurry produces poor manufacturing process control.

The short useful lifetime of some CMP slurries also produces other problems in existing CMP systems. For example, many CMP systems use large day tanks that hold significant quantities of CMP slurry to be used during an entire day or at least during an eight hour manufacturing shift. These day tanks consume large amounts of floor space and are expensive. Furthermore, large amounts of oxidizer must be added periodically to several types of CMP slurry stored in day tanks. Moreover, a new batch of CMP slurry may have a residence time or dwell time before the CMP slurry can be used or beyond which the CMP slurry may not be used. Therefore, the large quantities of CMP slurry in the day tanks may have residence time problems as new batches of slurry are introduced to the day tank and/or as older slurry ages beyond its useful life and must be rejuvenated via chemical additions.

Accordingly, a need exists for a method of manufacturing semiconductor components that includes a process for easily, accurately, and cost-effectively detecting and controlling a concentration of a component in a mixture. As applied to CMP processing, a need exists for a CMP system that can easily, accurately, and cost-effectively detect and control a concentration of an oxidizer or other time-sensitive chemical components in a CMP slurry.

BRIEF DESCRIPTION OF THE DRAWINGS

The invention will be better understood from a reading of the following detailed description, taken in conjunction with the accompanying drawing figures in which.

Figure 1:
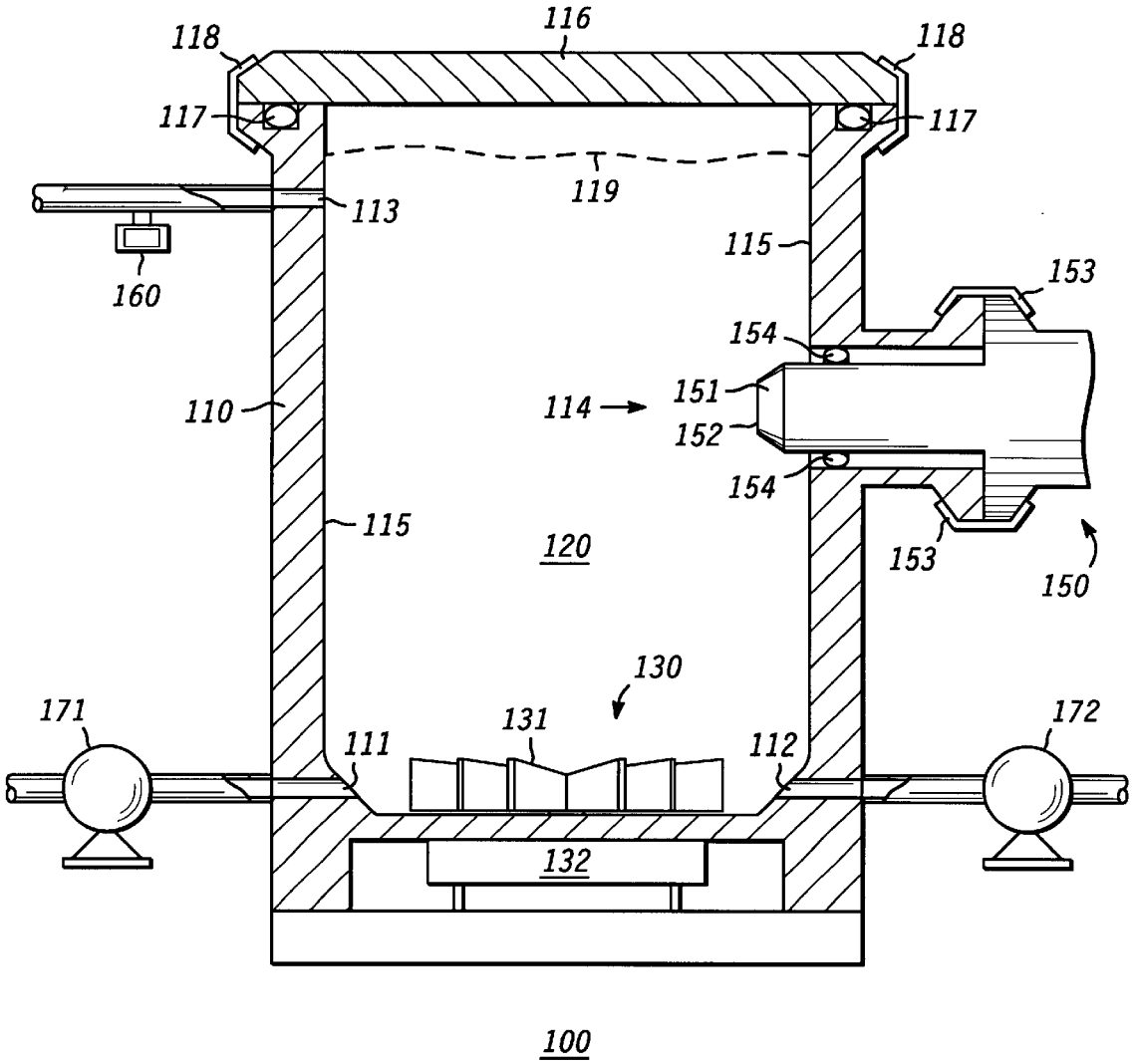
FIG. 1 illustrates a cross-sectional view of a portion of a chemical-mechanical polishing system in accordance with an embodiment of the invention.

For simplicity and clarity of illustration, the drawing figures illustrate the general manner of construction, and elements in the drawing figures are not necessarily drawn to scale. Additionally, the same reference numerals in different figures denote the same elements, and descriptions and details of well-known features and techniques are omitted to avoid unnecessarily obscuring the invention.

Furthermore, the terms first, second, third, fourth, top, bottom, over, under, above, below, and the like in the description and in the claims, if any, are used for distinguishing between similar elements and not necessarily for describing relative positions or a sequential or chronological order. However, it is understood that the embodiments of the invention described herein are capable of operation in other orientations or sequences than described or illustrated herein. It is further understood that the terms so used are interchangeable under appropriate circumstances.

DETAILED DESCRIPTION OF THE DRAWINGS

FIG. 1 illustrates a cross-sectional view of a portion of a Chemical-Mechanical Polishing (CMP) system 100. In particular, a portion of the chemical supply portion of system 100 is illustrated in FIG. 1. CMP system 100 comprises a vessel 110 having a first input port 111, a second input port 112, a CMP slurry output port 113, a CMP slurry sensing port 114, and a CMP slurry fill level represented by a dashed line 119. In the preferred embodiment, CMP slurry output port 113 is located below the CMP slurry fill level, and input ports 111 and 112 are located below CMP slurry output port 113. Also in the preferred embodiment, CMP slurry sensing port 114 is located below output port 113 and the CMP slurry fill level, and CMP slurry sensing port 114 is also located above input ports 111 and 112. The reasons for these preferred relative locations of input ports 111 and 112, CMP slurry output port 113, CMP slurry sensing port 114, and the CMP slurry fill level are explained hereinafter.

Vessel 110 also comprises an internal wall 115 defining a reservoir 120. In the preferred embodiment, wall 115 is smooth, but fins (not shown in FIG. 1) may extend from wall 115 to increase the turbulence within reservoir 120. In the preferred embodiment, vessel 110 and reservoir 120 are preferably sealed tightly so that pumps coupled to input ports 111, 112 can be used to pump the slurry components into vessel 110 through input ports 111, 112 and can also be used to pump the slurry out of vessel 110 through output port 113. In order to seal vessel 110 and reservoir 120, CMP system 100 can include a compliant o-ring 117, a rigid lid 116, and mechanical clamps 118 removably coupling or securing lid 116 to the top of vessel 110. O-ring 117 is used to provide an air-tight seal.

CMP system 100 can also comprise a dynamic mixing device 130 located at the bottom of vessel 110. Device 130 dynamically mixes the CMP slurry within reservoir 120. As an example, device 130 can include a rotating stirrer or blade 131 that is magnetically coupled to a magnetic actuator 132. In this embodiment of device 130, blade 131 is located within reservoir 120, and magnetic actuator 132 is located outside of reservoir 120.

During the operation of CMP system 100, a first component of the CMP slurry can be delivered into the bottom of reservoir 120 through input port 111, and a second component of the CMP slurry can be delivered into the bottom of reservoir 120 through input port 112. As an example, the first component can be an oxidizer, and the second component can be an abrasive comprised of silica particles in a liquid suspension or a liquid carrier. The CMP slurry can also be comprised of other components such as, for example, a buffered solution. As the components of the CMP slurry are introduced in the desired ratio into reservoir 120, device 130 dynamically mixes the components together to form the CMP slurry. Accordingly, device 130 is preferably located adjacent to input ports 111 and 112 such that the components of the CMP slurry can be mixed together immediately after being introduced into reservoir 120. As the CMP slurry is mixed together, additional amounts of the components of the CMP slurry are introduced into reservoir 120 to increase the amount of CMP slurry in reservoir 120 up to the CMP slurry fill level indicated by dashed line 119.

CMP system 100 also comprises a pump 171 coupled to input port 111. Pump 171 forces the first component of the CMP slurry into reservoir 120 through input port 111. CMP system 100 additionally comprises a pump 172 coupled to input port 112. Pump 172 forces the second component of the CMP slurry into reservoir 120 through input port 112. Pumps 171 and 172 can also be used to force the CMP slurry out of vessel 110 through output port 113 and to deliver the CMP slurry to the semiconductor, dielectric, or metal layer to be planarized or removed.

CMP system 100 further comprises an optical sensor or refractometer 150 located adjacent to CMP slurry sensing port 114. A first portion of refractometer 150 is located external to reservoir 120, and a second portion of refractometer 150 is located internal to reservoir 120. In particular, the second portion of refractometer 150 extends through CMP slurry sensing port 114, from wall 115 into reservoir 120.

In the preferred embodiment, the second portion of refractometer 150 protrudes into reservoir 120 away from or beyond wall 115. However, the second portion of refractometer 150 does not extend into a central portion of reservoir 120 so that interface 152 is not located within a vortex of the CMP slurry, but is located in a relatively high tangential velocity region of the CMP slurry within reservoir 120. In the preferred embodiment, CMP slurry sensing port 114 and interface 152 are located below the CMP slurry fill level indicated by dashed line 119 to avoid detecting or sensing any vapors within reservoir 120 above the CMP slurry.

As an example, refractometer 150 can be a model REFRAC DS Process Refractometer commercially available from the Uniloc Division of Rosemount Analytical, Incorporated of Irvine, Calif. This embodiment of refractometer 150 comprises a prism 151, and an interface 152 exists between the CMP slurry and prism 151. As an example, prism 151 can be comprised of sapphire.

Refractometer 150 is removably coupled or secured to vessel 110 by mechanical clamps 153, and o-ring 154 is located between the wall of CMP slurry sensing port 114 and refractometer 150 in order to provide an airtight seal between refractometer 150 and port 114. As the CMP slurry is introduced into reservoir 120 and is pushed upwards within reservoir 120 towards CMP output port 113, the CMP slurry moves pass CMP slurry sensing port 114 and refractometer 150 so that refractometer 150 can detect a concentration of the first component in the CMP slurry. In the preferred embodiment, the first component is comprised of hydrogen peroxide.

CMP system 100 also comprises a flow rate sensor 160 coupled to CMP slurry output port 113. Sensor 160 measures the flow rate of CMP slurry out of reservoir 120 through CMP slurry output port 113. Sensor 160 can be a level sensor, but is preferably an instantaneous flow sensor. As explained in more detail with reference to FIGS. 2 through 5, flow rate sensor 160 provides a first signal to adjust the flow rate of the first component of the CMP slurry through input port 111 and into vessel 110. Refractometer 150 provides a second signal to adjust the flow rate of the first component of the CMP slurry through input port 111 and into vessel 110.

CMP system 100 also includes other features not illustrated in FIG. 1, but known to those skilled in the art. For example, CMP system 100 further comprises supply tanks for the first and second components of the CMP slurry. The supply tanks can be coupled to pumps 171 and 172. CMP system 100 additionally comprises a carrier assembly for supporting a semiconductor substrate that optionally has a plurality of metal and dielectric layers. CMP system 100 additionally comprises a platen for mechanically polishing the semiconductor substrate or any of its dielectric or metal layers.

Figure 2:
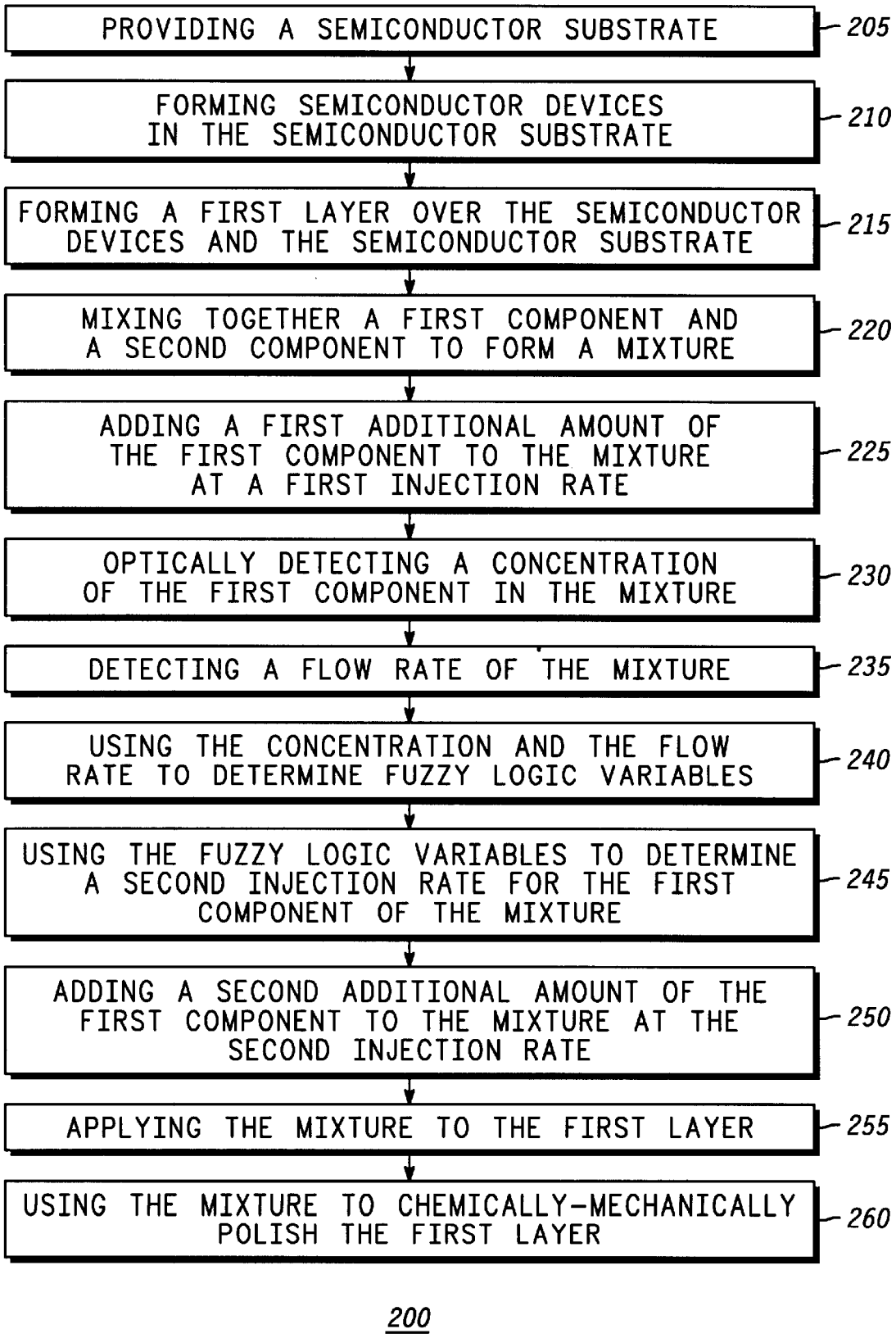
FIG. 2 illustrates a flow chart of a method of manufacturing a semiconductor component in accordance with an embodiment of the invention.

FIG. 2 illustrates a flowchart of a method 200 of manufacturing a semiconductor component. Method 200 uses CMP system 100 (FIG. 1). At a step 205 of method 200 in FIG. 2, a semiconductor substrate is provided. The semiconductor substrate can include at least one semiconductor epitaxial layer overlying a semiconductor support layer. Next, at a step 210 of method 200, a plurality of semiconductor devices are formed in the semiconductor substrate. Then, at a step 215 of method 200, a first layer is formed over the semiconductor substrate and the semiconductor devices. As an example, the first layer can be a dielectric layer comprised of silicon dioxide or silicon nitrate. However, in the preferred embodiment, the first layer is comprised of a metal such as, for example, copper, aluminum, titanium, or tungsten. When comprised of a metal, the first layer can be used as an interconnect layer.

At a step 220 of method 200, first and second components of a mixture are provided and mixed together. In the preferred embodiment, the mixture is a CMP slurry; the first component is an oxidizer such as, for example, hydrogen peroxide; and the second component is an abrasive such as, for example, silica particles suspended in a liquid carrier. The mixture can also be comprised of other components known to those skilled in the art of CMP processing. In the preferred embodiment, the first and second components are mixed or combined together within reservoir 120 of FIG. 1. Also in the preferred embodiment, the first and second components are dynamically mixed together by, for example, device 130 in FIG. 1. Further in the preferred embodiment, the first and second components are mixed together to form a homogenous mixture or solution, which facilitates uniform CMP processing.

When the first component is comprised of hydrogen peroxide, the mixture has a limited lifetime due to the decomposition of hydrogen peroxide into oxygen and water. Accordingly, at an optional step 225 of method 200 in FIG. 2, a first additional amount of the first component can be added to the mixture at a first injection rate or pump output volumetric rate. As an example, pump 171 in FIG. 1 can operate at a first stroke speed and a first stroke volume to provide the first injection rate. Pump 171 can be used to add the first component into reservoir 120 in FIG. 1. During optional step 225 of FIG. 2, the second component can also be added to the mixture. As an example, pump 172 in FIG. 1 can be used to add the second component into reservoir 120 in FIG. 1.

Next, at a step 230 of method 200 in FIG. 2, a concentration of the first component in the mixture is optically detected or measured. As an example, refractometer 150 (FIG. 1) can be used to quickly perform step 230. In the preferred embodiment, step 230 is performed in-situ within reservoir 120 (FIG. 1) while dynamically mixing together the first and second components. This fast, automated, and in-situ measurement provides a more accurate measurement of the concentration of the first component than a slow titration process.

Step 230 includes measuring an index of refraction of a portion of the mixture. In the preferred embodiment, the portion of the mixture is comprised of a boundary layer in the CMP slurry. As an example, the boundary layer is a liquid boundary layer comprised of the first component, or the oxidizer, and is devoid of the second component, or the abrasive particles. The liquid boundary layer is also comprised of other liquid components of the CMP slurry such as, for example, the liquid carrier for the abrasive particles. In the preferred embodiment, the liquid boundary layer is located around each of the abrasive particles. To measure the index of refraction of this boundary layer, the refractometer shines a light through a solid material such as, for example, prism 151 (FIG. 1) toward interface 152 (FIG. 1) between prism 151 and the CMP slurry within reservoir 120 (FIG. 1). The refractometer optically detects the angle of the light reflected off of interface 152 to determine the index of refraction of the liquid boundary layer surrounding the CMP slurry abrasive particles. The refractometer can be configured to detect a specific range of index of refraction. As an example, the range of the index of refraction can be approximately 1.333 to 1.340 when prism 151 is comprised of sapphire and when the first component is comprised of hydrogen peroxide. The measured index of refraction is directly and linearly proportional to the concentration of the first component within the mixture. This index of refraction measurement is not affected by the color, turgidity, clouding, solids, concentration of solids, or flow rate of the mixture. The concentration determined in step 230 is subsequently used to determine a second injection rate for the first component of the mixture.

Then, at a step 235 of method 200, a flow rate of the mixture is detected or measured. As an example, flow rate sensor 160 in FIG. 1 can be used to perform step 235 in FIG. 2. The flow rate determined in step 235 is subsequently used to determine a second injection rate for the first component of the mixture. The sequence of steps 230 and 235 can be reversed.

Next, at a step 240 of method 200, the concentration determined in step 230 and the flow rate determined in step 235 are used to determine fuzzy logic parameters or variables. As an example, the index of refraction measured in step 230 can be converted into a first signal by refractometer 150 (FIG. 1). As an example, the first signal can be a current or a voltage. This first signal is subsequently converted into at least one, and possibly two, fuzzy logic parameters or variables. Furthermore, the flow rate determined in step 235 is converted into a second signal by flow rate sensor 160 (FIG. 1). As an example, this second signal can be a current or a voltage. This second signal is subsequently converted into at least one, and possibly two, additional fuzzy logic parameters or variables. The details of these conversions into fuzzy logic variables are described in more detail with respect to FIGS. 3 and 4.

At a step 245 of method 200, the fuzzy logic variables are used to determine a second injection rate or pump stroke rate for the first component of the mixture. The details of step 245 are explained in more detail hereinafter with reference to FIGS. 5 and 6. As an example, steps 230, 235, 240, and 245 can be performed within 30 seconds.

Next, at a step 250 of method 200, a second additional amount of the first component is added to the mixture at the second injection rate. The second injection rate will most likely be different from the first injection rate. As an example, pump 171 in FIG. 1 can operate at a second speed to provide the second injection rate. Pump 171 can be used to add the first component into reservoir 120 in FIG. 1. During step 250 of FIG. 2, the second component can also be added to the mixture. As an example, pump 172 in FIG. 1 can be used to add the second component into reservoir 120 in FIG. 1.

Then, at a step 255 of method 200, the mixture is applied to the first layer over the semiconductor substrate, and at a step 260 of method 200, the mixture is used to chemically-mechanically polished to planarized or remove the first layer.

Figure 3:
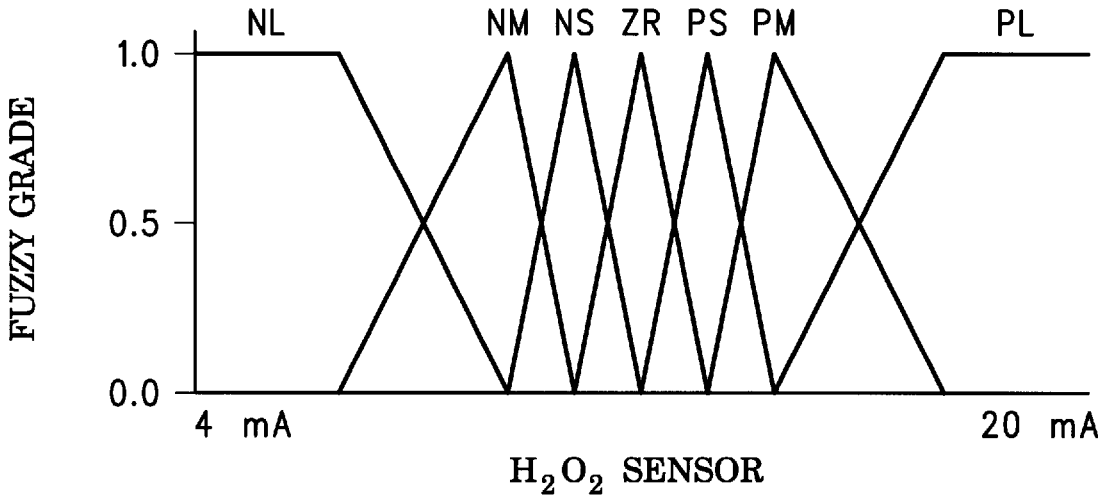
FIGS. 3 and 4 illustrate fuzzy logic graphs for the method of FIG. 2 in accordance with an embodiment of the invention.

FIG. 3 illustrates a fuzzy logic graph used in method 200 of FIG. 2. This graph in FIG. 3 converts the first signal from the refractometer into at least one fuzzy logic variable. The first signal is a current in FIG. 3. The x-axis or horizontal axis of the graph represents the output current from the refractometer. This x-axis ranges from approximately 4 milliAmperes (mA) to 20 mA. The y-axis or vertical axis represents the fuzzy grade of the fuzzy logic variable. The y-axis ranges from 0 to 1. The fuzzy logic variables illustrated in FIG. 3 include Negative Low (NL), Negative Medium (NM), Negative Small (NS), ZeRo (ZR), Positive Small (PS), Positive Medium (PM), and Positive Large (PL). In a Statistical Process Control (SPC) method, the NS and PS fuzzy logic variables can represent control limits while the NM and PM fuzzy logic variables can represent specification limits. As an example, the refractometer may convert the index of refraction into a current having a magnitude of approximately 11 mA, and the graph in FIG. 3 is used to convert the 11 mA output into two different fuzzy logic variables. The first fuzzy logic variable is NS with a fuzzy grade of approximately 0.8, and the second fuzzy logic variable is NM with a fuzzy grade of approximately 0.2.

Figure 4:
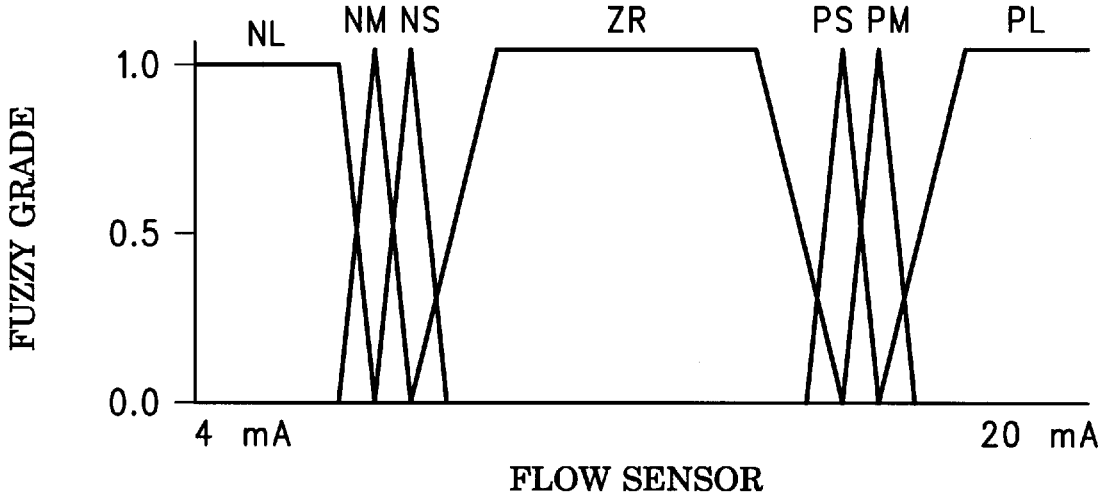

FIG. 4 illustrates a fuzzy logic graph used in method 200 of FIG. 2. This graph in FIG. 4 converts the second signal from the flow rate sensor into at least one fuzzy logic variable. The second signal is a current in FIG. 4. The x-axis or horizontal axis of the graph represents the output current from the flow rate sensor. The x-axis ranges from approximately 4 mA to 20 mA. The y-axis or vertical axis represents the fuzzy grade of the fuzzy logic variable. The y-axis ranges from 0 to 1. The fuzzy logic graph of FIG. 4 also includes seven fuzzy logic variables: NL, NM, NS, ZR, PS, PM, and PL. In a SPC method, the NS and PS fuzzy logic variables can represent control limits while the NM and PM fuzzy logic variable can represent specification limits. As an example, the flow rate sensor can convert the flow rate into a current having a magnitude of approximately 16 mA, and the graph in FIG. 4 is used to convert the 16 mA output into two fuzzy logic variables. The first fuzzy logic variable is PS with a fuzzy grade of approximately 0.6, and the second fuzzy variable logic is PM with a fuzzy grade of approximately 0.4.

Figures 5, 6:
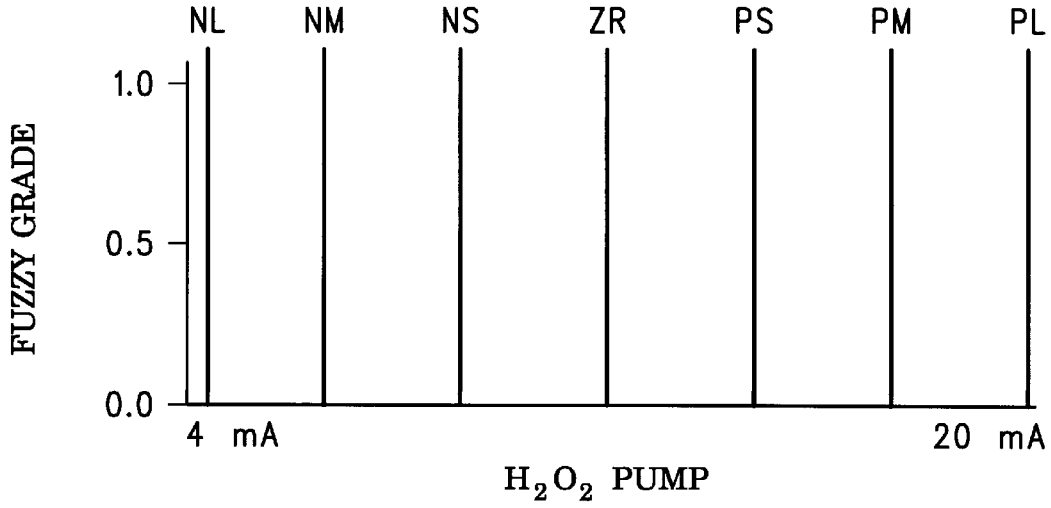
FIG. 5 illustrates a fuzzy logic table for the method of FIG. 2 in accordance with an embodiment of the invention.
FIG. 6 illustrates another fuzzy logic graph for the method of FIG. 2 in accordance with an embodiment of the invention.

FIG. 5 illustrates a fuzzy logic table used in method 200 of FIG. 2. The table of FIG. 5 converts the fuzzy logic variables from FIGS. 3 and 4 into other fuzzy logic variables. The table in FIG. 5 includes seven columns representing the seven fuzzy logic variables in FIG. 3, and the table in FIG. 5 also has seven rows representing the seven fuzzy logic variables of FIG. 4. The two fuzzy logic variables determined in FIG. 3 were NS and NM, and the two fuzzy logic variables determined in FIG. 4 were PS and PM. The intersection of these four fuzzy logic variables in the table of FIG. 5 produces four other fuzzy logic variables. For example, the intersection of the NM column with the PM row produces a fuzzy logic variable of PM, and the intersection of the NM column with PS row produces a fuzzy logic variable PM. Additionally, the intersection of the NS column with the PM row produces a fuzzy logic variable PM, and the intersection of the NS column with the PS row produces a fuzzy logic variable PS. Accordingly, the four resulting fuzzy logic variables are PM, PM, PM, and PS. These four fuzzy variables are averaged to produce a composite fuzzy logic variable of approximately 75 percent PM and 25 percent PS.

FIG. 6 illustrates another fuzzy logic graph used in method 200 of FIG. 2. The graph in FIG. 6 converts the composite fuzzy logic variable of FIG. 5 into the second injection rate for the first component of the mixture. The x-axis or horizontal axis of the graph in FIG. 6 represents the input current for the pump that controls the second injection rate. The x-axis ranges from approximately 4 mA to 20 mA. The y-axis or vertical axis represents the fuzzy grade of the composite fuzzy logic variable. The y-axis ranges from 0 to 1. The graph in FIG. 6 includes seven fuzzy logic variables: NL, NM, NS, ZR, PS, PM, and PL. Continuing with the example from FIG. 5, the composite fuzzy logic variable of 75 percent PM and 25 percent PS produces a current of approximately 15.5 mA in FIG. 6. This current is supplied to the pump for the first component. As an example, the 15.5 mA can be supplied to pump 171 in FIG. 1 to establish the second injection rate for the first component of the mixture.

Therefore, an improved method of manufacturing a semiconductor component and chemical-mechanical polishing system therefor is provided to overcome the disadvantages of the prior art. The thirty second optical detection cycle is much faster and more accurate than the fifteen minute titration cycle of the prior art. The optical detection is in-line and non-intrusive. Off-line sampling is not required, and no reagents are required. Accordingly, minimal training is required to use the CPM system or method described herein. Furthermore, the optical system is estimated to be approximately $30,000.00 to $70,000.00 less expensive than a conventional titration system. Thus, the method and system are also cost effective. Moreover, the fuzzy logic control system provides a faster and more accurate response that will not overshoot the intended target and that will also not oscillate around the intended target.

Although the invention has been described with reference to specific embodiments, it will be understood by those skilled in the art that various changes may be made without departing from the spirit or scope of the invention. For instance, the numerous details set forth herein such as, for example, the compositions of the mixture components are provided to facilitate the understanding of the invention and are not provided to limit the scope of the invention. Furthermore, the components of the mixture or CMP slurry can be altered depending upon the material to be polished or planarized. Additionally, the fuzzy logic can be used to adjust the pump stroke volume instead of, or in addition to, the pump stroke rate. Moreover, the method described herein is not limited to CMP processes, but can also be used for other processes such as, for example, semiconductor wafer cleaning where the index of refraction of the solute is different than that of the solvent and provides a significant change in the index of refraction depending on its concentration in the solvent. Accordingly, the disclosure of embodiments of the invention is intended to be illustrative of the scope of the invention and is not intended to be limiting. It is intended that the scope of the invention shall be limited only to the extent required by the appended claims.

What is claimed is:

1. A chemical-mechanical polishing (CMP) system comprising:

a vessel having a first input port, a CMP slurry output port, and a CMP slurry sensing port; and a refractometer adjacent to the CMP slurry sensing port.

2. The CMP system of claim 1 wherein:

the vessel has a CMP slurry fill level;

a first portion of the refractometer is located external to the vessel;

a second portion of the refractometer is located internal to the vessel; and the CMP slurry sensing port is located below the CMP slurry fill level in the vessel, above the first input port, and below the CMP slurry output port.

3. The CMP system of claim 1 wherein:

the vessel comprises an internal wall defining a reservoir; and the refractometer extends through the CMP slurry sensing port, from the internal wall into the reservoir.

4. The CMP system of claim 1 further comprising:

a flow rate sensor coupled to the CMP slurry output port; and a dynamic mixing device in the vessel, wherein:

the vessel has a second input port; and the CMP slurry sensing port is located above the first input port, above the second input port, above the dynamic mixing device, and below the CMP slurry output port.

5. The CMP system of claim 4 wherein:

the flow rate sensor provides a first signal to adjust a flow rate of a first component of a CMP slurry through the first input port and into the vessel; and the refractometer provides a second signal to adjust the flow rate of the first component of the CMP slurry through the first input port and into the vessel.

6. The CMP system of claim 5 wherein:

the refractometer provides a signal to adjust a flow rate of a first component of a CMP slurry through the first input port and into the vessel.

* * * * *

UNITED STATES PATENT AND TRADEMARK OFFICE

CERTIFICATE OF CORRECTION

PATENT NO. : 6,267,641 B1
DATED : July 31, 2001
INVENTOR(S) : James F. Vanell et al.

It is certified that error appears in the above-identified patent and that said Letters Patent is hereby corrected as shown below:

Column 8,
Line 57, delete "5" and add -- 1--.

Signed and Sealed this

Twenty-fourth Day of September, 2002

*Attest:*

*Attesting Officer*

JAMES E. ROGAN
*Director of the United States Patent and Trademark Office*